US011873461B1

(12) United States Patent
Edwards et al.

(10) Patent No.: US 11,873,461 B1
(45) Date of Patent: Jan. 16, 2024

(54) EXTREME PRESSURE ADDITIVES WITH IMPROVED COPPER CORROSION

(71) Applicant: AFTON CHEMICAL CORPORATION, Richmond, VA (US)

(72) Inventors: David Edwards, Richmond, VA (US); LeAnna Hobbs, O'Fallon, MO (US); Magdalena Makowska, Richmond, VA (US); Jon Jacoby, Millstadt, IL (US)

(73) Assignee: Afton Chemical Corporation, Richmond, VA (US)

( * ) Notice: Subject to any disclaimer, the term of this patent is extended or adjusted under 35 U.S.C. 154(b) by 0 days.

(21) Appl. No.: 17/934,442

(22) Filed: Sep. 22, 2022

(51) Int. Cl.

| | |
|---|---|
| ***C10M 151/02*** | (2006.01) |
| ***C10M 169/04*** | (2006.01) |
| *C10N 40/04* | (2006.01) |
| *C10N 20/00* | (2006.01) |
| *C10N 30/12* | (2006.01) |
| *C10N 20/04* | (2006.01) |

(52) U.S. Cl.
CPC ..... *C10M 151/02* (2013.01); *C10M 169/04* (2013.01); *C10M 2221/041* (2013.01); *C10N 2020/04* (2013.01); *C10N 2020/067* (2020.05); *C10N 2030/12* (2013.01); *C10N 2040/04* (2013.01)

(58) Field of Classification Search
CPC ..... C10M 169/04; C10M 151/02; C10M 2221/041; C10N 2020/067; C10N 2020/04; C10N 2030/12; C10N 2040/04
See application file for complete search history.

(56) References Cited

U.S. PATENT DOCUMENTS

| | | | |
|---|---|---|---|
| 2,129,264 | A | 9/1938 | Baxter et al. |
| 2,237,625 | A | 4/1941 | Olin |
| 2,237,627 | A | 4/1941 | Olin |
| 2,425,755 | A | 8/1947 | Roberts et al. |
| 2,425,845 | A | 8/1947 | Toussaint et al. |
| 2,448,664 | A | 9/1948 | Fife et al. |
| 2,457,139 | A | 12/1948 | Fife et al. |
| 2,475,755 | A | 7/1949 | Pearson |
| 2,527,948 | A | 10/1950 | Lyon, Jr. et al. |
| 2,568,876 | A | 9/1951 | White et al. |
| 2,695,316 | A | 11/1954 | Mcbride |
| 2,749,311 | A | 6/1956 | Sabol et al. |
| 2,760,933 | A | 8/1956 | Fields et al. |
| 2,765,289 | A | 10/1956 | Fields et al. |
| 2,850,453 | A | 9/1958 | Fields |
| 2,886,423 | A | 5/1959 | Kozikowski |
| 2,910,439 | A | 10/1959 | Fields |
| 2,995,569 | A | 8/1961 | Hamilton et al. |

(Continued)

FOREIGN PATENT DOCUMENTS

| | | | |
|---|---|---|---|
| CA | 2089833 | A1 | 8/1993 |
| CN | 101671584 | B | 3/2010 |

(Continued)

OTHER PUBLICATIONS

Smith, S. Scott et al. Measurement and Control of Fuel Injector Deposits in Direct Injection Gasoline Vehicles. SAE International; Oct. 14, 2013. doi:10.4271/2013-01-2616.

*Primary Examiner* — Vishal V Vasisth
(74) *Attorney, Agent, or Firm* — Honigman LLP

(57) ABSTRACT

A sulfurized extreme pressure additive and lubricant including the same providing good copper corrosion and seal compatibility.

22 Claims, 1 Drawing Sheet

(56) References Cited

U.S. PATENT DOCUMENTS 3,015,668 A 1/1962 Kozikowski
3,022,351 A 2/1962 Mihm et al.
3,027,246 A 3/1962 Bartlett
3,092,474 A 6/1963 Ebner
3,172,892 A 3/1965 Le Suer et al.
3,198,613 A 8/1965 Udelhofen
3,202,678 A 8/1965 Stuart et al.
3,216,936 A 11/1965 Le Suer et al.
3,219,666 A 11/1965 Norman et al.
3,254,025 A 5/1966 Le Suer
3,272,746 A 9/1966 Le Suer et al.
3,308,166 A 3/1967 Michel et al.
3,361,673 A 1/1968 Le Suer et al.
3,392,201 A 7/1968 Warner
3,468,640 A 9/1969 Barusch et al.
3,471,404 A 10/1969 Myers
3,663,561 A 5/1972 Blaha
3,673,090 A 6/1972 Waldbillig et al.
3,676,089 A 7/1972 Morris et al.
3,697,499 A 10/1972 Myers
3,703,504 A * 11/1972 Horodysky ..... C08G 75/00 568/18
3,703,505 A 11/1972 Horodysky et al.
3,778,371 A 12/1973 Malec
3,796,661 A 3/1974 Suratwala
3,840,549 A 10/1974 Blaha et al.
3,862,798 A 1/1975 Hopkins
3,873,454 A 3/1975 Horodysky et al.
4,038,043 A 7/1977 Garth
4,056,531 A 11/1977 Malec
4,067,698 A 1/1978 Steckel
4,119,549 A 10/1978 Davis
4,119,550 A 10/1978 Davis et al.
4,147,640 A 4/1979 Jayne et al.
4,152,499 A 5/1979 Boerzel et al.
4,171,959 A 10/1979 Vartanian
4,191,659 A 3/1980 Davis
4,204,969 A 5/1980 Papay et al.
4,218,332 A 8/1980 Schwab
4,231,759 A 11/1980 Udelhofen et al.
4,234,435 A 11/1980 Meinhardt et al.
4,240,958 A 12/1980 Braid
4,248,719 A 2/1981 Chafetz et al.
4,253,980 A 3/1981 Hammond et al.
4,326,973 A 4/1982 Hammond et al.
4,338,206 A 7/1982 Hammond et al.
4,344,854 A 8/1982 Davis et al.
4,472,306 A 9/1984 Powers et al.
4,482,357 A 11/1984 Hanlon
4,563,302 A 1/1986 Griffin et al.
4,564,709 A 1/1986 Koyama et al.
4,605,808 A 8/1986 Samson et al.
4,613,341 A 9/1986 Zaweski et al.
4,711,736 A 12/1987 Horodysky et al.
4,729,769 A 3/1988 Schlicht et al.
4,787,916 A 11/1988 Feldman
4,795,576 A 1/1989 Born et al.
4,827,040 A 5/1989 Labat
4,844,714 A 7/1989 Vogel et al.
4,877,416 A 10/1989 Campbell et al.
4,954,274 A 9/1990 Zaweski et al.
4,966,720 A 10/1990 DeGonia et al.
5,024,677 A 6/1991 Wang
5,062,976 A 11/1991 Audeh
5,091,112 A 2/1992 Perozzi et al.
5,174,922 A 12/1992 Perozzi et al.
5,250,174 A 10/1993 Hart
5,254,138 A 10/1993 Kurek
5,266,223 A 11/1993 Kurek
5,330,667 A 7/1994 Tiffany, III
5,393,309 A 2/1995 Cherpeck
5,410,088 A 4/1995 Harris et al.
5,514,190 A 5/1996 Cunningham et al.
5,518,511 A 5/1996 Russel et al.
5,575,823 A 11/1996 Wallace et al.
5,620,486 A 4/1997 Cherpeck
5,634,951 A 6/1997 Colucci et al.
5,697,988 A 12/1997 Malfer et al.
5,725,612 A 3/1998 Malfer et al.
5,752,989 A 5/1998 Henly et al.
5,756,428 A 5/1998 Emert et al.
5,792,731 A * 8/1998 Ichihashi ..... C10M 159/22 508/408
5,814,111 A 9/1998 Graham et al.
5,873,917 A 2/1999 Daly
5,876,468 A 3/1999 Moreton
6,048,373 A 4/2000 Malfer et al.
6,166,238 A 12/2000 Filipkowski et al.
6,405,711 B1 6/2002 Smith et al.
6,458,172 B1 10/2002 Macduff et al.
6,462,014 B1 10/2002 Johnson
6,475,250 B2 11/2002 Krull et al.
6,548,458 B2 4/2003 Loper
6,689,723 B2 2/2004 Sullivan et al.
6,695,890 B1 2/2004 Hazel et al.
6,730,773 B2 5/2004 Heinen
6,800,103 B2 10/2004 Malfer et al.
6,867,171 B2 3/2005 Harrison et al.
6,884,855 B2 4/2005 Nelson et al.
7,297,675 B2 11/2007 Alef
7,402,185 B2 7/2008 Aradi et al.
7,414,013 B2 8/2008 Nelson et al.
7,435,272 B2 10/2008 Aradi et al.
7,601,676 B2 * 10/2009 Stoneman ..... C10M 125/10 508/390
7,704,289 B2 4/2010 Alters et al.
7,744,660 B2 6/2010 Burrington et al.
7,766,982 B2 8/2010 Colucci et al.
7,906,470 B2 3/2011 Stevenson et al.
7,947,093 B2 5/2011 Barton et al.
7,951,211 B2 5/2011 Barton et al.
8,097,570 B2 1/2012 Boutout et al.
8,231,695 B2 7/2012 Cunningham et al.
8,425,627 B2 4/2013 Dietz et al.
8,449,630 B2 5/2013 Lange et al.
8,475,541 B2 7/2013 Fang et al.
8,486,876 B2 7/2013 Brewer et al.
8,496,716 B2 7/2013 Lange et al.
8,557,003 B2 10/2013 Malfer et al.
8,778,034 B2 7/2014 Cunningham
8,863,700 B2 10/2014 Fang et al.
8,894,726 B2 11/2014 Fang et al.
8,961,623 B2 2/2015 Stevenson et al.
8,974,551 B1 3/2015 Fang et al.
9,062,265 B2 6/2015 Reid et al.
9,090,850 B1 7/2015 Edwards et al.
9,340,742 B1 5/2016 Fang et al.
9,469,825 B2 10/2016 Tang
2003/0014910 A1 1/2003 Aradi et al.
2003/0131527 A1 7/2003 Colucci et al.
2004/0029766 A1 2/2004 Frick et al.
2004/0060226 A1 4/2004 Bongart et al.
2004/0167040 A1 8/2004 Dahlmann et al.
2005/0066572 A1 3/2005 Colucci et al.
2005/0120619 A1 6/2005 Koch
2005/0215411 A1 9/2005 Mackney et al.
2006/0070293 A1 4/2006 Lange et al.
2006/0168876 A1 8/2006 Colucci et al.
2006/0196110 A1 9/2006 Schwahn et al.
2006/0196111 A1 9/2006 Colucci et al.
2006/0223716 A1 10/2006 Milner et al.
2006/0272597 A1 12/2006 Burrington et al.
2007/0015681 A1 1/2007 Allef et al.
2007/0193119 A1 8/2007 Schwab
2007/0245621 A1 10/2007 Malfter et al.
2008/0086936 A1 4/2008 Cunningham et al.
2008/0113890 A1 5/2008 Moreton et al.
2008/0307698 A1 12/2008 Barton et al.
2009/0049740 A1 2/2009 Hurst
2009/0235576 A1 9/2009 Volkel et al.
2009/0282731 A1 11/2009 Malfer et al.
2010/0005706 A1 1/2010 Burgazli et al.
2010/0024289 A1 2/2010 Smith
2010/0037513 A1 2/2010 Petrucci et al.

(56) References Cited

U.S. PATENT DOCUMENTS

| | | | |
|---|---|---|---|
| 2010/0037514 | A1 | 2/2010 | Malfer et al. |
| 2010/0132253 | A1 | 6/2010 | Kaufman et al. |
| 2010/0151396 | A1 | 6/2010 | Papachristos et al. |
| 2010/0236510 | A1 | 9/2010 | Shea et al. |
| 2011/0162263 | A1 | 7/2011 | Vilardo et al. |
| 2011/0185626 | A1 | 8/2011 | Barton et al. |
| 2011/0237469 | A1 | 9/2011 | Khandekar et al. |
| 2011/0258917 | A1 | 10/2011 | Garcia et al. |
| 2011/0302828 | A1 | 12/2011 | Fang et al. |
| 2011/0308550 | A1 | 12/2011 | Reid |
| 2011/0315107 | A1 | 12/2011 | Grabarse et al. |
| 2012/0010112 | A1 | 1/2012 | Grabarse et al. |
| 2012/0101017 | A1 | 4/2012 | Duggal |
| 2012/0291339 | A1 | 11/2012 | Martin et al. |
| 2013/0031827 | A1 | 2/2013 | Reid et al. |
| 2013/0031828 | A1 | 2/2013 | Reid et al. |
| 2013/0104826 | A1 | 5/2013 | Burgess et al. |
| 2013/0220255 | A1 | 8/2013 | Fang |
| 2013/0233267 | A1 | 9/2013 | Barbour |
| 2013/0237466 | A1 | 9/2013 | Lange et al. |
| 2013/0247450 | A1 | 9/2013 | Wolf |
| 2013/0255139 | A1 | 10/2013 | Dolmazon et al. |
| 2013/0296210 | A1 | 11/2013 | Hansch et al. |
| 2013/0298948 | A1 | 11/2013 | Company et al. |
| 2013/0312318 | A1 | 11/2013 | Peretolchin et al. |
| 2013/0227878 | A1 | 12/2013 | Wolf et al. |
| 2013/0324665 | A1 | 12/2013 | Shaikh et al. |
| 2013/0333650 | A1 | 12/2013 | Fang et al. |
| 2014/0157655 | A1 | 6/2014 | Tort et al. |
| 2014/0174390 | A1 | 6/2014 | Reid et al. |
| 2015/0033617 | A1 | 2/2015 | Arondel et al. |
| 2015/0252277 | A1 | 9/2015 | Hansch et al. |
| 2016/0272912 | A1 | 9/2016 | Voelkel et al. |

FOREIGN PATENT DOCUMENTS

| | | | |
|---|---|---|---|
| EP | 0293192 | A1 | 11/1988 |
| EP | 0411861 | A1 | 3/1993 |
| EP | 0737674 | A2 | 10/1996 |
| EP | 1293553 | A2 | 3/2003 |
| EP | 1411105 | A2 | 4/2004 |
| EP | 1518918 | A1 | 3/2005 |
| EP | 1918355 | A1 | 5/2008 |
| EP | 2033945 | A1 | 3/2009 |
| EP | 1471133 | B1 | 7/2011 |
| EP | 2674471 | A1 | 12/2013 |
| EP | 2987845 | A1 | 2/2016 |
| GB | 0842728 | B1 | 7/1960 |
| GB | 1162334 | A1 | 8/1969 |
| GB | 1308894 | A | 3/1973 |
| GB | 2493377 | A1 | 2/2013 |
| WO | 2004050806 | A2 | 6/2004 |
| WO | 2005023965 | A1 | 3/2005 |
| WO | 2010132209 | A1 | 11/2010 |
| WO | 2013000738 | A2 | 1/2013 |
| WO | 2013017889 | A1 | 2/2013 |
| WO | 2013070503 | A1 | 5/2013 |
| WO | 2013092533 | A1 | 6/2013 |
| WO | 2015011505 | A1 | 1/2015 |
| WO | 2017168312 | A1 | 10/2017 |

* cited by examiner

EXTREME PRESSURE ADDITIVES WITH IMPROVED COPPER CORROSION

TECHNICAL FIELD

The present disclosure relates to extreme pressure additives and lubricating compositions including such additives suitable for gear oils, driveline applications, axle fluids, and/or power transmission fluids having improved characteristics for extreme pressure, friction, and/or copper corrosion.

BACKGROUND

Gears, transmissions, and/or axles commonly require lubricants that provide specific friction characteristics suitable for the desired application. Typically, such applications require the fluids to have proper extreme pressure performance, proper friction characteristics, and suitable copper corrosion performance among other performance requirements. A number of additives may be included in the lubricant to achieve desired performance. For instance, such lubricants may often include sulfurized additives to protect gears and other components from wear and scoring, and a sulfurized isobutylene oligomer or polymer is one exemplary extreme pressure additive for such applications. However, while sulfurized isobutylene oligomers or polymers may provide good extreme pressure and/or wear performance, such sulfurized additive tends to be detrimental to copper and copper alloys leading to unacceptable copper corrosion. Additionally, some sulfurized isobutylene oligomers or polymers, in some instances, also have an undesired shortcoming of being insoluble in API Group IV base oils, such as polyalphaolefin (PAO) base oils, that may limit the use of such additives in some applications.

SUMMARY

In one approach or embodiment, a sulfurized polyolefin oligomer made by a three-step process is described herein. In approaches, the product is made by the process comprising the steps of: (a) reacting a C2 to C18 olefin with a sulfur halide to form an intermediate sulfurized olefin reaction product; (b) reacting the intermediate sulfurized olefin reaction product with an alkali metal hydrosulfide, an alkali metal hydroxide, and sulfur in an aqueous solution to form a sulfurized polyolefin reaction product; and (c) treating the sulfurized polyolefin reaction product with an aqueous alkaline solution for a time and a temperature effective to form the improved sulfurized polyolefin oligomer.

In other approaches or embodiments, the product described in the previous paragraph may include optional features or embodiments in any combination. These optional features or embodiments may include one or more of the following: wherein a copper coupon immersed in the sulfurized polyolefin oligomer for about 180 minutes at about 121° C. pursuant to ASTM D130 exhibits about 15 mg or less of copper weight loss and wherein about 2 to about 5 weight percent of the sulfurized polyolefin oligomer is soluble in both an API Group III base oil and an API Group IV base oil; and/or wherein the sulfurized polyolefin oligomer has a structure of Formula I: $R—S_x—R—[S_x—R—S_x]_n—R$ (Formula I) wherein each R is, independently, a C2 to C6 linear or branched carbon chain, x is an integer from 1 to 5, and n is an integer such that the sulfurized polyolefin oligomer has a weight average molecular weight of about 300 to about 800; and/or wherein the sulfurized polyolefin oligomer has about 30 to about 50 weight percent sulfur; and/or wherein the olefin is selected from the group consisting of ethylene, propylene, isopropylene, butylene, isobutylene, n-pentylene, isopentylene, neopentylene, hexane, octane, styrene, aw-diolefins, 1,5-hexadiene, 1,6-heptadiene, 1,7-octadiene, branched chain alpha-olefins, methyl-pentene, methyl-heptene, or mixtures thereof; and/or wherein the sulfur halide is selected from sulfur monochloride, sulfur dichloride, disulfur dibromide, sulfur dibromide, or mixtures thereof; and/or wherein the aqueous alkaline solution includes an alkali metal hydroxide selected from sodium hydroxide, potassium hydroxide, lithium hydroxide or combinations thereof; and/or wherein the treating is at a temperature of about 100° C. to about 150° C. for about 1 to about 5 hours; and/or wherein the treating includes about 10 to about 50 weight percent of the aqueous alkaline solution; and/or wherein the aqueous alkaline solution is about 40 to about 60 weight percent of the alkali metal hydroxide and being free of alcohols or ketones; and/or wherein the intermediate sulfurized olefin reaction product of step (a) is obtained by reacting about 0.4 to about 2 mols of the C2 to C18 olefin per about 0.3 to about 0.8 moles of the sulfur halide; and/or wherein the sulfurized polyolefin reaction product of step (b) is obtained by reacting about 0.2 to about 0.5 mols of sulfur per mol of the intermediate sulfurized olefin reaction product, about 0.7 to about 1.1 moles of the alkali metal hydroxide per mol of the intermediate sulfurized olefin reaction product, and a weight ratio of 0.01:1 to about 0.25:1 of sulfur to the alkali metal hydrosulfide sodium; and/or wherein the sulfurized polyolefin oligomer of step (c) is obtained by treating the sulfurized polyolefin reaction product with about 10 to about 50 weight percent of the aqueous alkaline solution having about 40 to about 60 weight percent of an alkali metal hydroxide; and/or wherein the intermediate sulfurized olefin reaction product is obtained by reacting sulfur monochloride, sulfur dichloride, or combinations thereof with a C2 to C4 olefin, wherein the sulfurized polyolefin reaction product is obtained by reacting the intermediate sulfurized olefin reaction product with sodium hydrosulfide, sodium hydroxide, and elemental sulfur, and wherein the sulfurized polyolefin reaction product is treated with about 12 to about 40 weight percent of aqueous sodium hydroxide to form the sulfurized polyolefin oligomer.

In other approaches or embodiments, a lubricating composition including a major amount of base oil selected from an API Group I to API Group V base oil and a minor amount of a sulfurized polyolefin oligomer is described herein. In an aspect, the sulfurized polyolefin oligomer is made by a three-step process comprising the steps of (a) reacting a C2 to C18 olefin with a sulfur halide to form an intermediate sulfurized olefin reaction product; (b) reacting the intermediate sulfurized olefin reaction product with an alkali metal hydrosulfide, an alkali metal hydroxide, and sulfur in an aqueous solution to form a sulfurized polyolefin reaction product; and (c) treating the sulfurized polyolefin reaction product with an aqueous alkaline solution for a time and a temperature effective to form the sulfurized polyolefin oligomer.

The lubricating composition described in the previous paragraph may be combined with one or more optional features or embodiments in any combination. Such embodiment or features may include one or more of the following: wherein a copper coupon immersed in the sulfurized polyolefin oligomer for about 180 minutes at about 121° C. pursuant to ASTM D130 exhibits less than about 15 mg of copper weight loss and wherein about 2 to about 5 weight percent of the sulfurized polyolefin oligomer is soluble in both an API Group III base oil and an API Group IV base oil; and/or wherein the sulfurized polyolefin oligomer has a structure of Formula I: $R—S_x—R—[S_x—R—S_x]_n—R$ (Formula I) wherein each R is, independently, a C2 to C6 linear or branched carbon chain, x is an integer from 1 to 5, and n is an integer such that the sulfurized polyolefin oligomer has a weight average molecular weight of about 300 to about 800; and/or wherein the sulfurized polyolefin oligomer has about 30 to about 50 weight percent sulfur; and/or wherein the olefin is selected from the group consisting of ethylene, propylene, isopropylene, butylene, isobutylene, n-pentylene, isopentylene, neopentylene, hexane, octane, styrene, aw-diolefins, 1,5-hexadiene, 1,6-heptadiene, 1,7-octadiene, branched chain alpha-olefins, methyl-pentene, methyl-heptene, or mixtures thereof; and/or wherein the sulfur halide is selected from sulfur monochloride, sulfur dichloride, disulfur dibromide, sulfur dibromide, or mixtures thereof; and/or wherein the aqueous alkaline solution includes an alkali metal hydroxide selected from sodium hydroxide, potassium hydroxide, or combinations thereof; and/or wherein the treating is at a temperature of about 100° C. to about 150° C. for about 1 to about 5 hours; and/or wherein the treating includes about 10 to about 50 weight percent of the aqueous alkaline solution; and/or wherein the aqueous alkaline solution is about 40 to about 60 weight percent of the alkali metal hydroxide and being free of alcohol, ketones, or other alkanols; and/or wherein the intermediate sulfurized olefin reaction product of step (a) is obtained by reacting about 0.4 to about 2 mols of the C2 to C18 olefin per about 0.3 to about 0.8 moles of the sulfur halide; and/or wherein the sulfurized polyolefin reaction product of step (b) is obtained by reacting about 0.2 to about 0.5 mols of sulfur per mol of the intermediate sulfurized olefin reaction product, about 0.7 to about 1.1 moles of the alkali metal hydroxide per mol of the intermediate sulfurized olefin reaction product, and a weight ratio of 0.01:1 to about 0.25:1 of sulfur to the alkali metal hydrosulfide sodium; and/or wherein the sulfurized polyolefin oligomer of step (c) is obtained by treating the sulfurized polyolefin reaction product with about 10 to about 50 weight percent of the aqueous alkaline solution having about 40 to about 60 weight percent of an alkali metal hydroxide; and/or wherein the intermediate sulfurized olefin reaction product is obtained by reacting sulfur monochloride, sulfur dichloride, or combinations thereof with a C2 to C4 olefin, wherein the sulfurized polyolefin reaction product is obtained by reacting the intermediate sulfurized olefin reaction product with sodium hydrosulfide, sodium hydroxide, and elemental sulfur, and wherein the sulfurized polyolefin reaction product is treated with about 12 to about 40 weight percent of aqueous sodium hydroxide to form the sulfurized polyolefin oligomer.

In yet other embodiments, the use of a caustic wash or treatment, as described in any embodiment of this summary, for treating a sulfurized polyolefin reaction product is disclosed to form a sulfurized polyolefin oligomer wherein a copper coupon immersed in the sulfurized polyolefin oligomer for about 180 minutes at about 121° C. pursuant to ASTM D130 exhibits less than about 15 mg of copper weight loss and wherein about 2 to about 5 weight percent of the sulfurized polyolefin oligomer is soluble in both an API Group III base oil and an API Group IV base oil.

Other embodiments of the present disclosure will be apparent to those skilled in the art from consideration of the specification and practice of the invention disclosed herein. The following definitions of terms are provided in order to clarify the meanings of certain terms as used herein.

The terms "gear oil," "gear fluid," "gear lubricant," "base gear lubricant," "lubricating oil," "lubricant composition," "lubricating composition," "lubricant" and "lubricating fluid" refer to a finished lubrication product comprising a major amount of a base oil plus a minor amount of an additive composition as discussed herein. Such gear fluids are for use in extreme pressure situations such as for transmissions and gear drive components having metal-on-metal contact situations, for instance, in a transmission and/or a limited-slip differential.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having a predominantly hydrocarbon character. Each hydrocarbyl group is independently selected from hydrocarbon substituents, and substituted hydrocarbon substituents containing one or more of halo groups, hydroxyl groups, alkoxy groups, mercapto groups, nitro groups, nitroso groups, amino groups, pyridyl groups, furyl groups, imidazolyl groups, oxygen and nitrogen, and wherein no more than two non-hydrocarbon substituents are present for every ten carbon atoms in the hydrocarbyl group.

As used herein, the term "percent by weight" or "wt %", unless expressly stated otherwise, means the percentage the recited component represents to the weight of the entire composition. All percent numbers herein, unless specified otherwise, is weight percent.

The terms "soluble," "oil-soluble," or "dispersible" used herein may, but does not necessarily, indicate that the compounds or additives are soluble, dissolvable, miscible, or capable of being suspended in the oil in all proportions. The foregoing terms do mean, however, that they are, for instance, soluble, suspendable, dissolvable, or stably dispersible in oil to an extent sufficient to exert their intended effect in the environment in which the oil is employed. Moreover, the additional incorporation of other additives may also permit incorporation of higher levels of a particular additive, if desired.

The term "alkyl" as employed herein refers to straight, branched, cyclic, and/or substituted saturated chain moieties from about 1 to about 200 carbon atoms. The term "alkenyl" as employed herein refers to straight, branched, cyclic, and/or substituted unsaturated chain moieties from about 3 to about 30 carbon atoms. The term "aryl" as employed herein refers to single and multi-ring aromatic compounds that may include alkyl, alkenyl, alkylaryl, amino, hydroxyl, alkoxy, halo substituents, and/or heteroatoms including, but not limited to, nitrogen, and oxygen.

As used herein, the molecular weight is determined by gel permeation chromatography (GPC) using commercially available polystyrene standards (with a Mn of about 180 to about 18,000 as the calibration reference). The molecular weight (Mn) for any embodiment herein may be determined with a gel permeation chromatography (GPC) instrument obtained from Waters or the like instrument and the data processed with Waters Empower Software or the like software. The GPC instrument may be equipped with a Waters Separations Module and Waters Refractive Index detector (or the like optional equipment). The GPC operating conditions may include a guard column, 4 Agilent PLgel columns (length of 300×7.5 mm; particle size of 5μ, and pore size ranging from 100-10000 Å) with the column temperature at about 40° C. Un-stabilized HPLC grade tetrahydrofuran (THF) may be used as solvent, at a flow rate of 1.0 mL/min. The GPC instrument may be calibrated with commercially available polystyrene (PS) standards having a narrow molecular weight distribution ranging from 500-380,000 g/mol. The calibration curve can be extrapolated for samples having a mass less than 500 g/mol. Samples and PS standards can be in dissolved in THF and prepared at concentration of 0.1-0.5 weight percent and used without filtration. GPC measurements are also described in U.S. Pat. No. 5,266,223, which is incorporated herein by reference. The GPC method additionally provides molecular weight distribution information; see, for example, W. W. Yau, J. J. Kirkland and D. D. Bly, "Modern Size Exclusion Liquid Chromatography", John Wiley and Sons, New York, 1979, also incorporated herein by reference.

As used herein, any reported sulfur moiety distributions or ratios (i.e., —$S_x$—) were determined using CNMR via a Bruker Avance-3 HD 500 MHz instrument equipped with a 5 mm BBO Prodigy probe (or equivalent). Samples were dissolved in chloroform-d, about 3% wt/wt for the $^1$H NMR one-dimensional (1D) and two-dimensional (2D) homonuclear experiments and about 30% wt/wt for the $^{13}$C 1D and 2D heteronuclear experiments. The chloroform-d was used as the chemical shift reference, $d_H$=7.27 and $d_C$=77.0 ppm, respectively. The experiments were conducted at ambient temperature. The direct observe 1D $^1$H and $^{13}$C-$^1$H decoupled experiments were performed under quantitative conditions using ninety-degree pulse widths, 5×T1 delays and gated $^1$H decoupling for the $^{13}$C NMR experiments. In addition, a Distortionless Enhancement by Polarization Transfer (DEPT) experiment, using the 135-degree pulse option was also acquired. The 2D experiments used to assist in structural assignments were Homonuclear Correlated Spectroscopy (COSY), Heteronuclear Single Quantum Coherence (HSQC) and Heteronuclear Multiple Bond Correlation (HMBC). All NMR data was acquired using the Bruker Topspin 3.62 software from Bruker Inc of Billerica MA and processed using ACD/Spectrus Processor 2021.1.3 software from Advanced Chemistry Development, Inc. using standard parameters (or equivalent equipment/software).

It is to be understood that throughout the present disclosure, the terms "comprises," "includes," "contains," etc. are considered open-ended and include any element, step, or ingredient not explicitly listed. The phrase "consists essentially of" is meant to include any expressly listed element, step, or ingredient and any additional elements, steps, or ingredients that do not materially affect the basic and novel aspects of the invention. The present disclosure also contemplates that any composition described using the terms, "comprises," "includes," "contains," is also to be interpreted as including a disclosure of the same composition "consisting essentially of" or "consisting of" the specifically listed components thereof.

DETAILED DESCRIPTION

Figure 1:
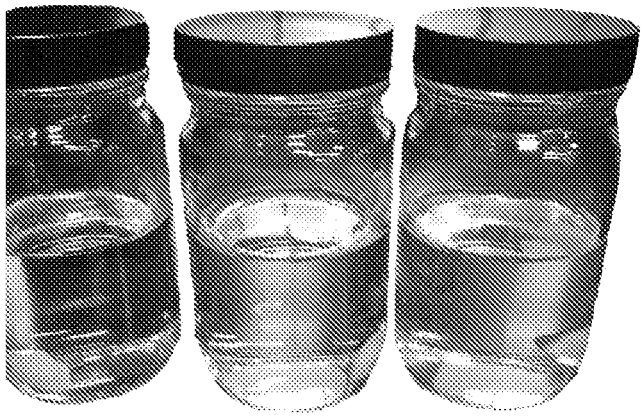
FIG. 1 is an image of three lubricant additives in a Group III base oil including one comparative and two inventive sulfurized isobutylene oligomers of the present disclosure showing that all oligomers are soluble in the Group III oil in view of the clear solutions in each container.

In approaches or embodiments of this disclosure, sulfurized polyolefin oligomer or polymer extreme pressure agents and lubricating compositions including such extreme pressure agents suitable for drivelines, gear fluids, power transmission fluids, and/or axle applications are provided. The sulfurized polyolefin oligomer or polymer extreme pressure additives herein provide good extreme pressure performance combined with one or more of low levels of copper corrosion, solubility in API Group III and Group IV base oils, and/or combinations thereof.

In one aspect, the sulfurized polyolefin oligomer or polymer extreme pressure agent of the present disclosure is made by a three-step process including at least the steps of: (a) reacting an olefin (such as a C2 to C18 olefin) with a sulfur halide to form an adduct or an intermediate sulfurized olefin reaction product; (b) reacting the adduct or the intermediate sulfurized olefin reaction product with an alkali metal hydrosulfide, an alkali metal hydroxide, and a source of sulfur in an aqueous solution to form a sulfurized polyolefin reaction product; and (c) washing or treating the sulfurized polyolefin reaction product with an aqueous alkaline solution for a time and a temperature effective to form the sulfurized polyolefin oligomer extreme pressure agent of the present disclosure. The resultant sulfurized polyolefin oligomer or polymer may be used as an extreme pressure additive and, in approaches or embodiments, provides improved copper corrosion and/or improved solubility in both API group III and API Group IV base oils. For instance, a copper coupon immersed in the sulfurized polyolefin oligomer (made by the three-step process of the present application) for about 180 minutes at about 121° C. pursuant to ASTM D130 exhibits about 15 mg or less of copper weight loss (preferably, about 10 mg or less of copper weight loss or about 5 mg or less of copper weight loss) and about 2 to about 5 weight percent (preferably 2 to 4 weight percent) of the sulfurized polyolefin oligomer is soluble in both an API Group III base oil and an API Group IV base oil.

In other approaches or embodiments, the sulfurized polyolefin oligomer or polymer, when prepared by the above-described three-step process, is distinct from a discrete polysulfide molecule and is a polymer or oligomer having a structure of Formula I:

$$R—S_x—R—[S_x—R—S_x]_n—R \quad \text{(Formula I)}$$

wherein each R is, independently, derived from an olefin (preferably, a C2 to C6 linear or branched carbon chain or hydrocarbyl group or other olefin as described below), x is an integer of at least 1, and preferably an integer from 1 to 5 (or an integer of 2 to 4 or an integer of 2 to 3), and n is an integer such that the overall sulfurized polyolefin oligomer or polymer has a weight average molecular weight of about 300 to about 800, preferably about 500 to about 750, or more preferably about 600 to about 750. In approaches, the sulfurized polyolefin oligomer has about 30 to about 50 weight percent total sulfur, preferably, about 40 to about 50 weight percent total sulfur, and more preferably, about 40 to about 45 weight percent total sulfur. As discussed more below, the sulfurized polyolefin oligomer herein is made by a three-step process.

The first step of the process is the reaction of an olefin with a sulfur halide to form an adduct or an intermediate sulfurized olefin reaction product. Suitable olefins for this first reaction step may be any unsaturated aliphatic hydrocarbon, and in some approaches, are olefins having 2 to 18 carbon atoms, in other approaches, 2 to 12 carbons, or in further approaches, 2 to 6 carbons. Examples of suitable olefins include, but are not limited to, ethylene, propylene, isopropylene, 1-butene, 2-butene, isobutene, 1-pentene, 2-pentene, 2-methyl-1-butene, 3-methyl-1-butene, 2-methyl-2-butene, 1-hexene, 2-hexene, 3-hexene, 2-methyl-1-pentene, 2-methyl-2-pentene, 2-ethyl-2-butene, neopentylene, hexane, octane, styrene, aw-diolefins, 1,5-hexadiene, 1,6-heptadiene, 1,7-octadiene, branched chain alpha-olefins, methyl-pentene, methyl-heptene, and the like olefins as well as mixtures thereof. Suitable olefins may also include branched olefins such as isobutene, 2-methyl-1-butene, 1-methyl-2-butene, 2-methyl-2-pentene and the like as well as mixtures thereof. Preferably, the olefin is isobutylene.

Suitable sulfur halide reactants for preparing the adduct or the intermediate sulfurized olefin reaction product of the first reaction step may be selected from sulfur monochloride, sulfur dichloride, disulfur dibromide, sulfur dibromide, or mixtures thereof. Preferably, the sulfur halide is sulfur monochloride, which those of skill appreciate is $S_2Cl_2$.

In approaches, the selected olefin may be added to the sulfur halide as a gas or liquid to form the adduct or the intermediate sulfurized olefin reaction product as a first step to form the extreme pressure additives herein. Preferably, the olefin is added beneath the surface of the sulfur halide as a gas. In practice, the selected olefin is added until the reaction with the sulfur halide stops as indicated, for instance, by loss of an exotherm. In approaches, about 0.4 to about 2 moles of olefin per each 0.3 to 0.8 moles of sulfur halide (such as sulfur monochloride) is suitable for the first reaction step of the methods herein.

In approaches, the adduct of the olefin and the sulfur halide (that is the intermediate sulfurized olefin reaction product) is formed free-of or without utilizing an alkanol promoter, a ketone, or other alcohol medium in the first process step. Preferably, the reaction takes place in an aqueous medium permitting higher reaction temperatures. As used herein, an alkanol promoter is any lower alcohol having 1 to 4 carbon atoms such as methanol, ethanol, n-propanol, isopropanol, isobutanol, tert-butanol and the like. As used herein, without or free of alcohols, ketones, or alkanol promotors means such process step has about 1 percent or less of alcohols, ketones, or alkanol promotors, about 0.5 weight percent or less, about 0.25 weight percent or less, about 0.1 weight percent or less, or no alcohols, ketones, or alkanol promotors.

The adduct forming step can be conducted at any temperature high enough to cause the reaction to proceed. In approaches or embodiments, the adduct or intermediate sulfurized olefin reaction product proceeds at a temperature of about 0° C. to about 100° C., in other approaches, about 0° C. to about 75° C., in yet other approaches, about 0° C. to about 40° C., and in yet further approaches, about 5° C. to about 40° C. or about 20° C. to about 40° C.

The adduct forming step should be conducted for a time sufficient to complete the reaction between the sulfur halide and olefin. This is usually limited by heat removal, and in approaches, the olefin feed rate may be controlled to hold the reaction temperature within the desired range. When the sulfur halide has been consumed, the temperature will drop. External heat may be added to continue the reaction for a further time if needed.

Next, the formed adduct or formed intermediate sulfurized olefin reaction product is treated or reacted in a second step with a further source of sulfur in an alkaline aqueous medium to form a sulfurized polyolefin reaction product. The further sulfur source may be selected from elemental sulfur and/or an metal sulfide such as sodium hydrosulfide, sodium sulfide, bismuth sulfide, copper sulfides, hydrogen sulfide, manganese sulfide, tin sulfide, and the like sulfur sources, or any combinations thereof. Preferably, the sulfur source is provided by elemental sulfur or an alkali metal sulfide or hydrosulfide, and most preferably, by a combination of elemental sulfur and sodium hydrosulfide. In approaches, the alkaline aqueous medium of this section reaction step includes an alkali metal hydroxide (such as a 40 to 60 weight percent aqueous solutions), such as sodium hydroxide, potassium hydroxide, lithium hydroxide, and the like, or combinations hereof. Preferably, the alkaline aqueous medium of this second reaction step includes sodium hydroxide, and more preferably, 50 percent aqueous sodium hydroxide. An optional alkanol may be used, such as propanol during the second reaction step.

In approaches, the alkaline aqueous medium of this second reaction step may include a mol ratio of sulfur atoms charged during this second step to the adduct from the first step of about 0.2:1 to about 0.5:1, in other approaches, about 0.22:1 to about 0.4:1, or in further approaches, about 0.25:1 to about 0.3:1. In some embodiments, the second reaction step of the methods herein may also have a weight ratio of elemental sulfur to metal sulfide (such as NaSH) of about 0.01:1 to about 0.25:1, in some approaches, from about 0.04:1 to about 0.2:1 and in other approaches, from about 0.08:1 to about 0.1:1.

When the metal sulfide and elemental sulfur are used as the further sulfur source in the second reaction step, the aqueous medium further comprises a basic solution, typically an aqueous solution of a metal hydroxide or an alkali metal hydroxide as noted above. In one approach, the alkaline aqueous medium preferably includes sodium hydroxide and may include more than about 0.7 moles of sodium hydroxide per mole of adduct, preferably more than about 0.8 moles of sodium hydroxide per mole of adduct, and most preferably in the range of from about 0.8 to about 1.1 moles of sodium hydroxide per mole of adduct.

In one approach of the second reaction step, the alkaline aqueous solution is first heated prior to adding the adduct or the intermediate sulfurized olefin reaction product. In an embodiment, the alkaline solution is heated to about 50° C. or higher, about 60° C. or above, or about 70° C. or more and, preferably, about 45° C. to about 65° C. or about 50° C. to about 65° C. The adduct or intermediate is then added with agitation for a period up to about 10 hours, and preferably about 2 to about 4 hours. The mixture is then maintained at the elevated temperature for a period of time sufficient to form an organic phase containing the sulfurized polyolefin reaction product.

The formed sulfurized polyolefin reaction product from the above-described two reaction steps may be used as an extreme pressure additive, but tends to have the shortcoming of being more corrosive to copper and, in some circumstances, not soluble in API Group IV base oils as exemplified below in the Examples. Thus, the methods herein further treat or wash the formed sulfurized polyolefin reaction product in a third method step using a wash or treatment step with caustic solution or an aqueous alkaline solution for a time and temperature effective to form the sulfurized polyolefin oligomer of the present disclosure having the improved copper corrosion and Group IV base oil solubility.

In an approach, the third method step of the present disclosure washes or treats the formed sulfurized polyolefin reaction product from the second process step with a caustic solution or an aqueous alkaline solution including an alkali metal hydroxide. In an approach or embodiment, the caustic or aqueous alkaline solution includes sodium hydroxide, potassium hydroxide, lithium hydroxide or combinations thereof. Preferably, this final treatment or wash step is using a caustic solution of sodium hydroxide. The wash or treatment step may be at a temperatures of about 100° C. or higher, such as temperatures of about 100° C. to about 150° C. (in other approaches, about 100° C. to about 130° C., or in yet other approaches, about 105° C. to about 115° C.) for about 1 to about 5 hours (in other approaches, about 2 to about 4 hours, or in other approaches, about 2 to about 3 hours).

In some approaches, the wash or treating step includes about 10 to about 50 weight percent of the caustic/aqueous alkaline solution or, in other approaches, about 10 to about 20 weight percent, or about 30 to about 50 weight percent of the caustic/aqueous alkaline solution based on the total amount of the sulfurized polyolefin reaction product and the caustic solution in the wash step. Preferably, the aqueous alkaline solution used in the wash step is a water solution including about 40 to about 60 weight percent of the alkali metal hydroxide (preferably, a 50 percent solution of caustic or sodium hydroxide) and being free of alcohol, ketones, and/or alkanol promotors as discussed above. For instance, the washing or final treatment steps are free of alcohols, ketones, or alkanol promotors and, in such context, have about 1 percent or less of alcohols, ketones, or alkanol promotors, about 0.5 weight percent or less, about 0.25 weight percent or less, about 0.1 weight percent or less, or no alcohols, ketones, or alkanol promotors in the final washing or treatment steps.

In one preferred approach, the adduct or intermediate sulfurized olefin reaction product is obtained by reacting sulfur monochloride, sulfur dichloride, or combinations thereof (and preferably sulfur monochloride) with a C2 to C4 olefin (and preferably isobutylene) in the first step of the process. Next, the sulfurized polyolefin reaction product is obtained by reacting the adduct or the intermediate sulfurized olefin reaction product with sodium hydrosulfide, sodium hydroxide, and elemental sulfur in the second step of the process. Lastly, the sulfurized polyolefin reaction product is treated or washed with about 15 to about 40 weight percent of caustic or aqueous sodium hydroxide in the third or final step of the process for a time and at a temperature to form the final sulfurized polyolefin oligomer or polymer of the present disclosure having the improved copper corrosion and improved API Group IV base oil solubility.

As shown in the Examples below, the three-step process herein to form a sulfurized polyolefin oligomer or polymer forms an extreme pressure additive that also exhibits low copper corrosion and solubility in API Group IV base oil, such as polyalphaolefins. Moreover, high levels of sulfur typically is detrimental to copper corrosion, but when lubricating compositions herein include the sulfurized polyolefin oligomers or polymers made by the methods herein, the compositions can surprisingly include comparable and/or higher levels of total sulfur yet achieve better copper corrosion performance than comparative fluids including prior sulfurized oligomers or polyolefins.

In one approach, sulfurized polyolefin oligomer or polymer as described above may be used as an extreme pressure additive in suitable base oils and optionally combined with one or more other additives as needed for driveline, transmission, gear oils, or axle lubricant applications having, for instance, a KV100 (ASTM 445) of about 6 to about 18 cSt or, in some approaches, about 12 to about 18 cSt or, in other approaches, about 6 to about 12 cSt.

Base Oil

Suitable base oils for use in the lubricating composition or gear fluids herein include mineral oils, synthetic oils, and include all common mineral oil basestocks. The mineral oil may be naphthenic or paraffinic. The mineral oil may be refined by conventional methodology using acid, alkali, and clay or other agents such as aluminium chloride, or may be an extracted oil produced, e.g. by solvent extraction with solvents such as phenol, sulfur dioxide, furfural or dichlorodiethyl ether. The mineral oil may be hydrotreated or hydrofined, dewaxed by chilling or catalytic dewaxing processes, or hydrocracked, such as the Yubase® family of hydrockracked base oils from SK Innovation Co., Ltd. (Seoul, Korea). The mineral oil may be produced from natural crude sources or be composed of isomerized wax materials or residues of other refining processes.

The base oil or base oil of lubricating viscosity used in the compositions herein may be selected from any suitable base oil for driveline or gear oil applications. Examples include the base oils in Groups I-V as specified in the American Petroleum Institute (API) Base Oil Interchangeability Guidelines. These three base oil groups are as follows:

TABLE 1

Base oil Types

| Base Oil Category | Sulfur (%) | | Saturates (%) | Viscosity Index |
|---|---|---|---|---|
| Group I | >0.03 | and/or | <90 | 80 to 120 |
| Group II | ≤0.03 | and | ≥90 | 80 to 120 |
| Group III | ≤0.03 | and | ≥90 | ≥120 |
| Group IV | All polyalphaolefins (PAOs) | | | |
| Group V | All others not included in Groups I, II, III, or IV | | | |

Groups I, II, and III are mineral oil process stocks and may be preferred for the driveline or gear fluids of the present application. It should be noted that although Group III base oils are derived from mineral oil, the rigorous processing that these fluids undergo causes their physical properties to be very similar to some true synthetics, such as PAOs. Therefore, oils derived from Group III base oils may be referred to as synthetic fluids in the industry. Suitable oils may be derived from hydrocracking, hydrogenation, hydrofinishing, unrefined, refined, and re-refined oils, and mixtures thereof. In some approaches, the base oil may be a blend of Group I and Group II oils and the blend may be about 0% to about 100% of the Group I oil, about 0% to about 100% of the Group II oil, about 0% to about 100% of the Group III oil, or various blends of Group I and II, Group I and III, or Group II and III oil blends.

Unrefined oils are those derived from a natural, mineral, or synthetic source without or with little further purification treatment. Refined oils are similar to the unrefined oils except that they have been treated in one or more purification steps, which may result in the improvement of one or more properties. Examples of suitable purification techniques are solvent extraction, secondary distillation, acid or base extraction, filtration, percolation, and the like. Oils refined to the quality of an edible may or may not be useful. Edible oils may also be called white oils. In some embodiments, lubricating oil compositions are free of edible or white oils.

Re-refined oils are also known as reclaimed or reprocessed oils. These oils are obtained similarly to refined oils using the same or similar processes. Often these oils are additionally processed by techniques directed to removal of spent additives and oil breakdown products.

Mineral oils may include oils obtained by drilling or from plants and animals or any mixtures thereof. For example such oils may include, but are not limited to, castor oil, lard oil, olive oil, peanut oil, corn oil, soybean oil, and linseed oil, as well as mineral lubricating oils, such as liquid petroleum oils and solvent-treated or acid-treated mineral lubricating oils of the paraffinic, naphthenic or mixed paraffinic-naphthenic types. Such oils may be partially or fully hydrogenated, if desired. Oils derived from coal or shale may also be useful.

The major amount of base oil included in the gear fluids herein may be selected from the group consisting of Group I, Group II, a Group III, and a combination of two or more of the foregoing, and wherein the major amount of base oil is other than base oils that arise from provision of additive components or viscosity index improvers in the composition. In another embodiment, the major amount of base oil included in a lubricating composition may be selected from the group consisting of Group I, a Group II, and a combination of two or more of the foregoing, and wherein the major amount of base oil is other than base oils that arise from provision of additive components or viscosity index improvers in the composition.

The base oil may also be any of the synthetic base oils. Useful synthetic lubricating oils may include hydrocarbon oils such as polymerized, oligomerized, or interpolymerized olefins (e.g., polybutylenes, polypropylenes, propyleneisobutylene copolymers); poly(1-hexenes), poly(1-octenes), trimers or oligomers of 1-decene, e.g., poly(1-decenes), such materials being often referred to as α-olefins, and mixtures thereof; alkyl-benzenes (e.g. dodecylbenzenes, tetradecylbenzenes, dinonylbenzenes, di-(2-ethylhexyl)-benzenes); polyphenyls (e.g., biphenyls, terphenyls, alkylated polyphenyls); diphenyl alkanes, alkylated diphenyl alkanes, alkylated diphenyl ethers and alkylated diphenyl sulfides and the derivatives, analogs and homologs thereof or mixtures thereof. Polyalphaolefins are typically hydrogenated materials.

Other synthetic lubricating oils include polyol esters, diesters, liquid esters of phosphorus-containing acids (e.g., tricresyl phosphate, trioctyl phosphate, and the diethyl ester of decane phosphonic acid), or polymeric tetrahydrofurans. Synthetic oils may be produced by Fischer-Tropsch reactions and typically may be hydroisomerized Fischer-Tropsch hydrocarbons or waxes. In one embodiment oils may be prepared by a Fischer-Tropsch gas-to-liquid synthetic procedure as well as other gas-to-liquid oils.

The amount of the base oil of lubricating viscosity in the compositions herein may be the balance remaining after subtracting from 100 wt % the sum of the amount of the performance additives. For example, the oil of lubricating viscosity that may be present in a finished fluid may be a "major amount," such as greater than about 50 wt %, greater than about 60 wt %, greater than about 70 wt %, greater than about 80 wt %, greater than about 85 wt %, greater than about 90 wt %, or greater than about 95 wt %.

In some approaches, a preferred base oil or base oil of lubricating viscosity has less than about 25 ppm sulfur, a viscosity index greater than about 120 ppm, and a kinematic viscosity at about 100° C. of about 2 to about 8 cSt. In other approaches, the base oil of lubricating viscosity has less than about 25 ppm sulfur, a viscosity index greater than 120, and a kinematic viscosity at 100° C. of about 4 cSt. The base oil may have CP (paraffinic carbon content) of greater than 40%, greater than 45%, greater than 50%, greater than 55%, or greater than 90%. The base oil may have a CA (aromatic carbon content) of less than 5%, less than 3%, or less than 1%. The base oil may have a CN (naphthenic carbon content) of less than 60%, less than 55%, less than 50%, or less than 50% and greater than 30%. The base oil may have a ratio of 1 ring naphthenes to 2-6 ring naphthenes of less than 2 or less than 1.5 or less than 1.

A suitable driveline or gear lubricant composition herein may include additive components in the ranges listed in the following Table 2.

TABLE 2

Suitable and Preferred Driveline or Gear Fluid Compositions

| Component | wt % (Suitable Embodiments) | wt % (Other Embodiments) |
|---|---|---|
| Sulfurized polyolefin oligomer or polymer | 1.5-5 | 1.6-3.2 |
| Antioxidant(s) | 0.1-5.0 | 0.01-4.0 |
| Detergent(s) | 0.0-15.0 | 1.0-8.0 |
| Corrosion inhibitor(s) | 0.0-5.0 | 0.1-3.0 |
| Ash-free phosphorus compound(s) | 0.0-15.0 | 0.1-5.0 |
| Antifoaming agent(s) | 0.0-1.0 | 0.001-0.5 |
| Antiwear agent(s) | 0.0-1.0 | 0.0-0.8 |
| Pour point depressant(s) | 0.0-1.0 | 0.01-0.5 |
| Viscosity index improver(s) | 0.0-20.0 | 0.1-10.0 |
| Dispersants | 0.0-10.0 | 1.0-6.0 |
| Dispersant viscosity index improver(s) | 0.0-10.0 | 0.0-5.0 |
| Friction modifier(s) | 0.0-10.0 | 0.01-4.0 |
| Other Extreme Pressure Agent | 0.0-1.05 | 0.035-.35 |
| Base oil(s) | Balance | Balance |
| Total | 100 | 100 |

The percentages of each component above represent the weight percent of each component, based upon the weight of the total final additive or lubricating oil composition. The balance of the lubricating oil composition consists of one or more base oils or solvents. Additives used in formulating the compositions described herein may be blended into the base oil or solvent individually or in various sub-combinations. However, it may be suitable to blend all of the components concurrently using an additive concentrate (i.e., additives plus a diluent, such as a hydrocarbon solvent).

The lubricating composition described herein may be formulated to provide lubrication, enhanced friction performance properties, and improved copper corrosion for various applications. The driveline lubricating compositions herein may be used for lubricating a machine part, such as a gear. Lubricating fluids according to the present disclosure can be used in gear applications, such as industrial gear applications, automotive gear applications, axles, and stationary gearboxes. Gear-types can include, but are not limited to, spur, spiral, worm, rack and pinion, involute, bevel, helical, planetary, and hypoid gears and as well as limited-slip applications and differentials. The driveline lubricating compositions disclosed herein are also suitable for automatic or manual transmissions, including step automatic transmissions, continuously variable transmissions, semi-automatic transmissions, automated manual transmissions, toroidal transmissions, and dual clutch transmissions. The driveline lubricating compositions herein are particularly suited for use in axles, transfer cases, differentials, such as straight differentials, turning differentials, limited-slip differentials, clutch-type differentials, and locking differentials, and the like.

Optional Additives

In other approaches, the lubricant including such additives noted above may also include one or more optional components so long as such components and amounts thereof do not impact the performance characteristics as described in the above paragraphs. These optional components are described in the following paragraphs.

Phosphorus-Containing Compounds

The lubricant composition herein may comprise one or more phosphorus-containing compounds that may impart anti-wear benefits to the fluid. The one or more phosphorus-containing compounds may be present in the lubricating oil composition in an amount ranging from about 0 wt % to about 15 wt %, or about 0.01 wt % to about 10 wt %, or about 0.05 wt % to about 5 wt %, or about 0.1 wt % to about 3 wt % of the lubricating oil composition. The phosphorus-containing compound may provide up to 5000 ppm phosphorus, or from about 50 to about 5000 ppm phosphorus, or from about 300 to about 1500 ppm phosphorus, or up to 600 ppm phosphorus, or up to 900 ppm phosphorus to the lubricant composition.

The one or more phosphorus-containing compounds may include ashless phosphorus-containing compounds. Examples of suitable phosphorus-containing compound include, but are not limited to, thiophosphates, dithiophosphates, phosphates, phosphoric acid esters, phosphate esters, phosphites, phosphonates, phosphorus-containing carboxylic esters, ethers, or amides salts thereof, and mixtures thereof. Phosphorus containing anti-wear agents are more fully described in European Patent 0612839.

It should be noted that often the term phosphonate and phosphite are used often interchangeably in the lubricant industry. For example, dibutyl hydrogen phosphonate is often referred to as dibutyl hydrogen phosphite. It is within the scope of the present invention for the inventive lubricant composition to include a phosphorus-containing compound that may be referred to as either a phosphite or a phosphonate.

In any of the above described phosphorus-containing compounds, the compound may have about 5 to about 20 weight percent phosphorus, or about 5 to about 15 weight percent phosphorus, or about 8 to about 16 weight percent phosphorus, or about 6 to about 9 weight percent phosphorus.

The inclusion of the phosphorus-containing compound in combination with the above described dispersant to a lubricant compositions unexpectedly imparts positive frictional characteristics, such as a low friction coefficient, to the lubricant composition. The inventive effect is even further pronounced in some cases where the phosphorus-containing compound, on its own, imparts negative frictional characteristics to the fluid. When these relatively poor friction reducing phosphorus-containing compounds are combined with the olefin copolymer dispersant described herein, the lubricant composition has an improved, i.e., lower, friction coefficient. That is, the dispersants herein tend to transform fluids containing phosphorus-containing compounds having relatively poor friction coefficients into fluids with improved frictional properties.

This improvement in frictional properties of the lubricating compositions including the phosphorus-containing compounds and the olefin copolymer dispersant described herein is surprising because the frictional properties of the fluid are better than combinations of the phosphorus-containing compounds in combination with other types of dispersants, including polyisobutylene succinimide dispersants and olefin copolymer succinimide dispersants that do not have the specified characteristics of the copolymers described above.

Another type of phosphorus-containing compound that when combined with the olefin copolymer dispersant herein imparts improved frictional characteristics to a lubricating composition is an ashless (metal free) phosphorus-containing compound.

In some embodiments, the ashless phosphorus-containing compound may be dialkyl dithiophosphate ester, amyl acid phosphate, diamyl acid phosphate, dibutyl hydrogen phosphonate, dimethyl octadecyl phosphonate, salts thereof, and mixtures thereof.

The ashless phosphorus-containing compound may be have the formula:

(Formula XIV)

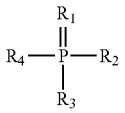

wherein R1 is S or O; R2 is —OR, —OH, or —R"; R3 is —OR", —OH, or SR'"C(O)OH; R4 is —OR"; R'" is C1 to C3 branched or linear alkyl chain; and R" is a C1 to C18 hydrocarbyl chain. When the phosphorous-containing compound has the structure shown in Formula XIV, the compound may have about 8 to about 16 weight percent phosphorus.

In some embodiments the lubricant composition comprises a phosphorus-containing compound of Formula XIV wherein R1 is S; R2 is —OR"; R3 is S R'"COOH; R4 is —OR"; R'" is C3 branched alkyl chain; R" is C4; and wherein the phosphorus-containing compound is present in an amount to deliver between 80-900 ppm phosphorus to the lubricant composition.

In another embodiment, the lubricant composition comprises a phosphorus-containing compound of Formula XIV wherein R1 is O; R2 is —OH; R3 is —OR" or —OH; R4 is —OR"; R" is C5; and wherein phosphorus-containing compound is present in an amount to deliver between 80-1500 ppm phosphorus to the lubricant composition.

In yet another embodiment, the lubricant composition comprises a phosphorus-containing compound of Formula XIV wherein R1 is O; R2 is OR"; R3 is H; R4 is —OR"; R" is C4; and wherein the one or more phosphorus-containing compound(s) is present in an amount to deliver between 80-1550 ppm phosphorus to the lubricant composition.

In other embodiments, the lubricant composition comprises a phosphorus-containing compound of Formula XIV wherein R1 is O; R2 is —R"; R3 is —OCH3 or —OH; R4 is —OCH3; R" is C18; and wherein the one or more phosphorus-containing compound(s) is present in an amount to deliver between 80-850 ppm phosphorus to the lubricant composition.

In some embodiments, the phosphorus-containing compound has the structure shown in Formula XIV and delivers about 80 to about 4500 ppm phosphorus to the lubricant composition. In other embodiments, the phosphorus-containing compound is present in an amount to deliver between about 150 and about 1500 ppm phosphorus, or between about 300 and about 900 ppm phosphorus, or between about 800 to 1600 ppm phosphorus, or about 900 to about 1800 ppm phosphorus, to the lubricant composition.

Anti-wear Agents

The lubricant composition may also include other anti-wear agents that are non-phosphorus-containing compounds. Examples of such antiwear agents include borate esters, borate epoxides, thiocarbamate compounds (including thiocarbamate esters, alkylene-coupled thiocarbamates, and bis(S-alkyldithiocarbamyl)disulfides, thiocarbamate amides, thiocarbamic ethers, alkylene-coupled thiocarbamates, and bis(S-alkyldithiocarbamyl) disulfides, and mixtures thereof), sulfurized olefins, tridecyl adipate, titanium compounds, and long chain derivatives of hydroxyl carboxylic acids, such as tartrate derivatives, tartramides, tartrimides, citrates, and mixtures thereof. A suitable thiocarbamate compound is molybdenum dithiocarbamate. Suitable tartrate derivatives or tartrimides may contain alkyl-ester groups, where the sum of carbon atoms on the alkyl groups may be at least 8. The tartrate derivative or tartrimide may contain alkyl-ester groups, where the sum of carbon atoms on the alkyl groups may be at least 8. The antiwear agent may in one embodiment include a citrate. The additional anti-wear agent may be present in ranges including about 0 wt % to about 15 wt %, or about 0.01 wt % to about 10 wt %, or about 0.05 wt % to about 5 wt %, or about 0.1 wt % to about 3 wt % of the lubricating oil composition.

Other Extreme Pressure Agents

The lubricant compositions of the disclosure may also contain other extreme pressure agent(s) so long as the lubricating compositions herein include the noted amounts and profiles set forth herein. The optional extreme pressure agent may contain sulfur and may contain at least 12 percent by weight sulfur. In some embodiments, the extreme pressure agent added to the lubricating oil is sufficient to provide at least 350 ppm sulfur, 500 ppm sulfur, 760 ppm sulfur, from about 350 to about 2,000 ppm sulfur, from about 2,000 to about 30,000 ppm sulfur, or from about 2,000 to about 4,800 ppm sulfur, or about 4,000 to about 25,000 ppm sulfur to the lubricant composition.

A wide variety of sulfur-containing extreme pressure agents are suitable and include sulfurized animal or vegetable fats or oils, sulfurized animal or vegetable fatty acid esters, fully or partially esterified esters of trivalent or pentavalent acids of phosphorus, sulfurized olefins (see, for example U.S. Pat. Nos. 2,995,569; 3,673,090; 3,703,504; 3,703,505; 3,796,661; 3,873,454 4,119,549; 4,119,550; 4,147,640; 4,191,659; 4,240,958; 4,344,854; 4,472,306; and 4,711,736), dihydrocarbyl polysulfides (see for example U.S. Pat. Nos. 2,237,625; 2,237,627; 2,527,948; 2,695,316; 3,022,351; 3,308,166; 3,392,201; 4,564,709; and British 1,162,334), functionally-substituted dihydrocarbyl polysulfides (see for example U.S. Pat. No. 4,218,332), and polysulfide olefin products (see for example U.S. Pat. No. 4,795,576). Other suitable examples include organo-sulfur compounds selected from sulfurized olefins, sulfur-containing amino heterocyclic compounds, 5-dimercapto-1,3,4-thiadiazole, polysulfides having a majority of S3 and S4 sulfides, sulfurized fatty acids, sulfurized branched olefins, organic polysulfides, and mixtures thereof.

In some embodiments the extreme pressure agent is present in the lubricating composition in an amount of up to about 3.0 wt % or up to about 5.0 wt %. In other embodiments, the extreme pressure agent is present from about 0.05 wt % to about 0.5 wt %, based on the total lubricant composition. In other embodiments, the extreme pressure agent is present from about 0.1 wt % to about 3.0 wt %, based on the total lubricant composition. In other embodiments the extreme pressure agent is present in an amount between about 0.6 wt % and about 1 wt %, based on the total lubricant composition. In yet other embodiments, the detergent is present in an amount of about 1.0 wt %, based on the total lubricant composition.

One suitable class of extreme pressure agents are polysulfides composed of one or more discrete compounds represented by the formula: Ra-Sx-Rb where Ra and Rb are hydrocarbyl groups each of which may contain 1 to 18, and in other approaches, 3 to 18 carbon atoms and x is may be in the range of from 2 to 8, and typically in the range of from 2 to 5, especially 3. In some approaches, x is an integer from 3 to 5 with about 30 to about 60 percent of x being an integer of 3 or 4. The hydrocarbyl groups can be of widely varying types such as alkyl, cycloalkyl, alkenyl, aryl, or aralkyl. Tertiary alkyl polysulfides such as di-tert-butyl trisulfide, and mixtures comprising di-tert-butyl trisulfide (e.g., a mixture composed principally or entirely of the tri, tetra-, and pentasulfides) may be used. Examples of other useful dihydrocarbyl polysulfides include the diamyl polysulfides, the dinonyl polysulfides, the didodecyl polysulfides, and the dibenzyl polysulfides.

Another suitable class of extreme pressure agent is sulfurized isobutenes made by reacting an olefin, such as isobutene, with sulfur. Sulfurized isobutene (SIB), notably sulfurized polyisobutylene, typically has a sulfur content of from about 10 to about 55%, desirably from about 30 to about 50% by weight. A wide variety of other olefins or unsaturated hydrocarbons, e.g., isobutene dimer or trimer, may be used to form the sulfurized olefin extreme pressure agents. Various methods have been disclosed in the prior art for the preparation of sulfurized olefins. See, for example, U.S. Pat. No. 3,471,404 to Myers; U.S. Pat. No. 4,204,969 to Papay et al.; U.S. Pat. No. 4,954,274 to Zaweski et al.; U.S. Pat. No. 4,966,720 to DeGonia et al.; and U.S. Pat. No. 3,703,504 to Horodysky, et al, each of which his incorporated herein by reference.

Methods for preparing sulfurized olefins, including the methods disclosed in the aforementioned patents, generally involve formation of a material, typically referred to as an adduct", in which an olefin is reacted with a sulfur halide, for example, sulfur monochloride. The adduct is then reacted with a sulfur source to provide the sulfurized olefin. The quality of a sulfurized olefin is generally measured by various physical properties, including, for example, viscosity, sulfur content, halogen content and copper corrosion test weight loss. U.S. Pat. No. 4,966,720, relates to sulfurized olefins useful as extreme pressure additives in lubrication oils and to a two stage reaction for their preparation.

Antioxidants

The lubricating oil compositions herein also may optionally contain one or more antioxidants. Antioxidant compounds are known and include for example, phenates, phenate sulfides, sulfurized olefins, phosphosulfurized terpenes, sulfurized esters, aromatic amines, alkylated diphenylamines (e.g., nonyl diphenylamine, di-nonyl diphenylamine, octyl diphenylamine, di-octyl diphenylamine), phenyl-alpha-naphthylamines, alkylated phenyl-alpha-naphthylamines, hindered non-aromatic amines, phenols, hindered phenols, oil-soluble molybdenum compounds, macromolecular antioxidants, or mixtures thereof. Antioxidant compounds may be used alone or in combination.

The hindered phenol antioxidant may contain a secondary butyl and/or a tertiary butyl group as a sterically hindering group. The phenol group may be further substituted with a hydrocarbyl group and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant may be an ester and may include, e.g., Irganox® L-135 available from BASF or an addition product derived from 2,6-di-tert-butylphenol and an alkyl acrylate, wherein the alkyl group may contain about 1 to about 18, or about 2 to about 12, or about 2 to about 8, or about 2 to about 6, or about 4 carbon atoms. Another commercially available hindered phenol antioxidant may be an ester and may include Ethanox® 4716 available from Albemarle Corporation.

Useful antioxidants may include diarylamines and phenols. In an embodiment, the lubricating oil composition may contain a mixture of a diarylamine and a phenol, such that each antioxidant may be present in an amount sufficient to provide up to about 5 wt %, based on the weight of the lubricant composition. In an embodiment, the antioxidant may be a mixture of about 0.3 wt % to about 1.5 wt % diarylamine and about 0.4 wt % to about 2.5 wt % phenol, based on the lubricant composition.

Examples of suitable olefins that may be sulfurized to form a sulfurized olefin include propylene, butylene, isobutylene, polyisobutylene, pentene, hexene, heptene, octene, nonene, decene, undecene, dodecene, tridecene, tetradecene, pentadecene, hexadecene, heptadecene, octadecene, nonadecene, eicosene or mixtures thereof. In one embodiment, hexadecene, heptadecene, octadecene, nonadecene, eicosene or mixtures thereof and their dimers, trimers and tetramers are especially useful olefins. Alternatively, the olefin may be a Diels-Alder adduct of a diene such as 1,3-butadiene and an unsaturated ester, such as, butylacrylate.

Another class of sulfurized olefin includes sulfurized fatty acids and their esters. The fatty acids are often obtained from vegetable oil or animal oil and typically contain about 4 to about 22 carbon atoms. Examples of suitable fatty acids and their esters include triglycerides, oleic acid, linoleic acid, palmitoleic acid or mixtures thereof. Often, the fatty acids are obtained from lard oil, tall oil, peanut oil, soybean oil, cottonseed oil, sunflower seed oil or mixtures thereof. Fatty acids and/or ester may be mixed with olefins, such as α-olefins.

The one or more antioxidant(s) may be present in ranges about 0 wt % to about 20 wt %, or about 0.1 wt % to about 10 wt %, or about 1 wt % to about 5 wt %, of the lubricating oil composition.

Dispersants

Dispersants contained in the lubricant composition may include, but are not limited to, an oil soluble polymeric hydrocarbon backbone having functional groups that are capable of associating with particles to be dispersed. Typically, the dispersants comprise amine, alcohol, amide, or ester polar moieties attached to the polymer backbone often via a bridging group. Dispersants may be selected from Mannich dispersants as described in U.S. Pat. Nos. 3,634,515, 3,697,574 and 3,736,357; ashless succinimide dispersants as described in U.S. Pat. Nos. 4,234,435 and 4,636,322; amine dispersants as described in U.S. Pat. Nos. 3,219,666, 3,565,804, and 5,633,326; Koch dispersants as described in U.S. Pat. Nos. 5,936,041, 5,643,859, and 5,627,259, and polyalkylene succinimide dispersants as described in U.S. Pat. Nos. 5,851,965; 5,853,434; and 5,792,729.

In some embodiments, the additional dispersant may be derived from a polyalphaolefin (PAO) succinic anhydride, an olefin maleic anhydride copolymer. As an example, the additional dispersant may be described as a poly-PIBSA. In another embodiment, the additional dispersant may be derived from an anhydride which is grafted to an ethylene-propylene copolymer. Another additional dispersant may be a high molecular weight ester or half ester amide.

The additional dispersant, if present, can be used in an amount sufficient to provide up to about 10 wt %, based upon the final weight of the lubricating oil composition. Another amount of the dispersant that can be used may be about 0.1 wt % to about 10 wt %, or about 0.1 wt % to about 10 wt %, or about 3 wt % to about 8 wt %, or about 1 wt % to about 6 wt %, based upon the final weight of the lubricating oil composition.

Viscosity Index Improvers

The lubricant compositions herein also may optionally contain one or more viscosity index improvers. Suitable viscosity index improvers may include polyolefins, olefin copolymers, ethylene/propylene copolymers, polyisobutenes, hydrogenated styrene-isoprene polymers, styrene/maleic ester copolymers, hydrogenated styrene/butadiene copolymers, hydrogenated isoprene polymers, alpha-olefin maleic anhydride copolymers, polymethacrylates, polyacrylates, polyalkyl styrenes, hydrogenated alkenyl aryl conjugated diene copolymers, or mixtures thereof. Viscosity index improvers may include star polymers and suitable examples are described in US Publication No. 20120101017A1, which is incorporated herein by reference.

The lubricating oil compositions herein also may optionally contain one or more dispersant viscosity index improvers in addition to a viscosity index improver or in lieu of a viscosity index improver. Suitable viscosity index improvers may include functionalized polyolefins, for example, ethylene-propylene copolymers that have been functionalized with the reaction product of an acylating agent (such as maleic anhydride) and an amine; polymethacrylates functionalized with an amine, or esterified maleic anhydride-styrene copolymers reacted with an amine.

The total amount of viscosity index improver and/or dispersant viscosity index improver may be about 0 wt % to about 20 wt %, about 0.1 wt % to about 15 wt %, about 0.1 wt % to about 12 wt %, or about 0.5 wt % to about 10 wt %, about 3 wt % to about 20 wt %, about 3 wt % to about 15 wt %, about 5 wt % to about 15 wt %, or about 5 wt % to about 10 wt %, of the lubricating oil composition.

In some embodiments, the viscosity index improver is a polyolefin or olefin copolymer having a number average molecular weight of about 10,000 to about 500,000, about 50,000 to about 200,000, or about 50,000 to about 150,000. In some embodiments, the viscosity index improver is a hydrogenated styrene/butadiene copolymer having a number average molecular weight of about 40,000 to about 500,000, about 50,000 to about 200,000, or about 50,000 to about 150,000. In some embodiments, the viscosity index improver is a polymethacrylate having a number average molecular weight of about 10,000 to about 500,000, about 50,000 to about 200,000, or about 50,000 to about 150,000.

Other Optional Additives

Other additives may be selected to perform one or more functions required of lubricant composition. Further, one or more of the mentioned additives may be multi-functional and provide functions in addition to or other than the function prescribed herein. The other additives may be in addition to specified additives of the present disclosure and/or may comprise one or more of metal deactivators, viscosity index improvers, ashless TBN boosters, antiwear agents, corrosion inhibitors, rust inhibitors, dispersants, dispersant viscosity index improvers, extreme pressure agents, antioxidants, foam inhibitors, demulsifiers, emulsifiers, pour point depressants, seal swelling agents and mixtures thereof. Typically, fully-formulated lubricating oil will contain one or more of these additives.

Suitable metal deactivators may include derivatives of benzotriazoles (typically tolyltriazole), dimercaptothiadiazole derivatives, 1,2,4-triazoles, benzimidazoles, 2-alkyldithiobenzimidazoles, or 2-alkyldithiobenzothiazoles; foam inhibitors including copolymers of ethyl acrylate and 2-ethylhexylacrylate and optionally vinyl acetate; demulsifiers including trialkyl phosphates, polyethylene glycols, polyethylene oxides, polypropylene oxides and (ethylene oxide-propylene oxide) polymers; pour point depressants including esters of maleic anhydride-styrene, polymethacrylates, polyacrylates or polyacrylamides.

Suitable foam inhibitors include silicon-based compounds, such as siloxane.

Suitable pour point depressants may include a polymethylmethacrylates or mixtures thereof. Pour point depressants may be present in an amount sufficient to provide from about 0 wt % to about 1 wt %, about 0.01 wt % to about 0.5 wt %, or about 0.02 wt % to about 0.04 wt % based upon the final weight of the lubricating oil composition.

Suitable rust inhibitors may be a single compound or a mixture of compounds having the property of inhibiting corrosion of ferrous metal surfaces. Non-limiting examples of rust inhibitors useful herein include oil-soluble high molecular weight organic acids, such as 2-ethylhexanoic acid, lauric acid, myristic acid, palmitic acid, oleic acid, linoleic acid, linolenic acid, behenic acid, and cerotic acid, as well as oil-soluble polycarboxylic acids including dimer and trimer acids, such as those produced from tall oil fatty acids, oleic acid, and linoleic acid. Other suitable corrosion inhibitors include long-chain alpha, omega-dicarboxylic acids in the molecular weight range of about 600 to about 3000 and alkenylsuccinic acids in which the alkenyl group contains about 10 or more carbon atoms such as, tetrapropenylsuccinic acid, tetradecenylsuccinic acid, and hexadecenylsuccinic acid. Another useful type of acidic corrosion inhibitors are the half esters of alkenyl succinic acids having about 8 to about 24 carbon atoms in the alkenyl group with alcohols such as the polyglycols. The corresponding half amides of such alkenyl succinic acids are also useful. A useful rust inhibitor is a high molecular weight organic acid. In some embodiments, an engine oil is devoid of a rust inhibitor.

The rust inhibitor, if present, can be used in optional amount sufficient to provide about 0 wt % to about 5 wt %, about 0.01 wt % to about 3 wt %, about 0.1 wt % to about 2 wt %, based upon the final weight of the lubricating oil composition.

The lubricant composition may also include corrosion inhibitors (it should be noted that some of the other mentioned components may also have copper corrosion inhibition properties). Suitable inhibitors of copper corrosion include ether amines, polyethoxylated compounds such as ethoxylated amines and ethoxylated alcohols, imidazolines, monoalkyl and dialkyl thiadiazole, and the like.

Thiazoles, triazoles and thiadiazoles may also be used in the lubricants. Examples include benzotriazole, tolyltriazole, octyltriazole, decyltriazole; dodecyltriazole, 2-mercaptobenzothiazole, 2,5-dimercapto-1,3,4-thiadiazole, 2-mercapto-5-hydrocarbylthio-1,3,4-thiadiazoles, and 2-mercapto-5-hydrocarbyldithio-1,3,4-thiadiazoles. In one embodiment, the lubricant composition includes a 1,3,4-thiadiazole, such as 2-hydrocarbyldithio-5-mercapto-1,3,4-dithiadiazole.

Anti-foam/Surfactant agents may also be included in a fluid according to the present invention. Various agents are known for such use. Copolymers of ethyl acrylate and hexyl ethyl acrylate, such as PC-1244, available from Solutia may be used. In other embodiments, silicone fluids, such as 4% DCF may be included. Mixtures of anti-foam agents may also be present in the lubricant composition.

EXAMPLES

The following examples are illustrative of exemplary embodiments of the disclosure. In these examples, as well as elsewhere in this application, all ratios, parts, and percentages are by weight unless otherwise indicated. It is intended that these examples are being presented for the purpose of illustration only and are not intended to limit the scope of the invention disclosed herein.

Comparative Example 1

A comparative sulfurized polyolefin oligomer was prepared as follows: In a first reaction step, liquid sulfur monochloride (about 73.6 grams) was charged to a reactor equipped with a stirrer, thermometer, a condenser, chiller system, and a sub-surface gas sparger. Gaseous isobutylene (about 57.5 grams) was bubbled into the reactor below the surface of the sulfur monochloride liquid while stirring. Temperature was maintained at or around 25° C.

Next, a reactor was charged with about 4.7 grams of elemental sulfur, about 1.8 grams n-propanol, about 29.0 grams of 50 percent aqueous sodium hydroxide, about 42.3 grams of 38 weight percent aqueous sodium hydrosulfide, and about 0.007 grams of antifoam. The mixture was stirred and heated under nitrogen to about 55° C. at which time the isobutylene-sulfur monochloride adduct from the first reaction above was added over a 4 hour period while maintaining the reaction mass at reflux (about 80° C. to about 94° C.). Heat was continued for two hours and then the alcohol was stripped out by heating up to about 94° C. Following the atmospheric strip, the pressure was reduced to 150 mm of Hg while allowing the flask to cool to about 70° C. to complete the removal of the alcohol and most of the water. To the resulting product was added wash water which, after stirring for about 10 minutes, was allowed to settle for about 5 minutes. The lower aqueous brine layer was separated and the organic layer was vacuum stripped (<100 mm Hg) at about 100° C. After filtering the stripped organic layer through a bed of diatomaceous earth, a clear yellow oil was obtained comprising a sulfurized isobutylene oligomer. The formed product had a viscosity in the range of about 7.0 to about 9.0 cSt at 100° C. and a total sulfur content of about 45.5 to about 48.5 weight percent.

Example 1

The sulfurized isobutylene oligomer of Comparative Example 1 was further treated with an aqueous alkaline solution as follows: about 1250 grams of the sulfurized isobutylene reaction product of Comparative Example 1 was added to a 2 liter reactor with a separatory funnel, water cooled condenser with condensate receiver, and a vacuum pump. About 464 grams of a 50 percent sodium hydroxide solution was added at an agitation rate of 700 rpms. The mixture was reacted at about 110° C. for about 3 hours to form a caustic treated sulfurized isobutylene oligomer. The formed caustic treated sulfurized isobutylene oligomer had a specific gravity of 1.1076, about 0.1 weight percent water, and about 43.0 weight percent total sulfur.

Example 2

In another example, the sulfurized isobutylene oligomer of Comparative Example 1 was further processed with an aqueous alkaline solution as follows: about 1250 grams of the sulfurized isobutylene reaction product of Comparative Example 1 was added to a 2 liter reactor with a separatory funnel, water cooled condenser with condensate receiver, and a vacuum pump. About 209 grams of a 50 percent sodium hydroxide solution was added at an agitation rate of 700 rpms. The mixture was reacted at about 110° C. for about 3 hours to form a caustic treated sulfurized isobutylene oligomer. The formed caustic treated sulfurized isobutylene oligomer had a specific gravity of about 1.1155, about 0.12 weight percent water, and about 43.8 weight percent total sulfur.

Example 3

The sulfurized isobutylene oligomer of Comparative Example 1 and the two Inventive caustic treated sulfurized isobutylene oligomers of Examples 1 and 2 were evaluated for copper corrosion as follows: a copper SAE CA 110 annealed 2.75"×0.6"×16 gauge polished coupon (available from Metaspec, San Antonio, Texas) was immersed in about 35 grams of each inventive and comparative sulfurized isobutylene (as a neat fluid) and subjected to the aging procedures of ASTM D130 at 121° C. for about 180 minutes. The mass of the copper test strip was measured before the aging and after the 180 minutes of immersion in the respective neat solutions. Before weighing the copper test strip post-test, it was washed with heptane and vigorously rubbed with a heptane moistened towel to remove any loose black scaly material. The copper test strip was given a final wash with acetone and completely dried before weighing. The copper corrosion weight loss (CCT) was reported from the test as follows: CCT=Mass pre-test—Mass post-test in units of mg. Results are provided in Table 3 below.

TABLE 3

| Sulfurized Isobutylene Oligomer | CCT, mg of copper |
|---|---|
| Comparative Example 1 | 53.9 |
| Inventive Example 1 | 11.7 |
| Inventive Example 2 | 4.8 |

Example 4

The sulfurized isobutylene of Comparative Example 1 and the two Inventive caustic-treated sulfurized isobutylene oligomers of Example 1 and 2 were evaluated for extreme pressure performance using the FZG Sprung test as described in FVA information sheet #243 (designated as S-A-10/16.6R/90 or 120). The FZG Sprung test may be performed at any number of test houses, such as the FZG institute, Southwest Research Institute, or other suitable test house. Passing extreme pressure performance is a wear scar of approximately 115 $mm^2$ or less at a load stage of 10 or higher as compared to a reference lubricant at 90° C.

For the extreme pressure evaluations, each of the sulfurized isobutylene oligomers of Comparative Example 1 and Inventive Examples 1 and 2 was blended into a lubricant at a treat rate of about 1.4 weight percent sulfur provided by the oligomer. The lubricating compositions also included the same amounts of an additive package including the same pour point depressant, antiwear additive, and antifoam. The compositions also included the balance of base oils and/or process oils as needed to achieve a target KV100 of about 6 to about 18 cSt, and preferably 13 to 18 cSt. (ASTM D445.)

TABLE 4

| Lubricant | Sulfurized Isobutylene | FZG, load stage 10, mm2 of damage |
|---|---|---|
| Lubricant A (Comparative) | Comparative Example 1 | 110 |
| Lubricant B (Inventive) | Example 1 | 115 |
| Lubricant C (Inventive) | Example 2 | 40 |

Table 4 shows that inventive lubricants provided comparable extreme pressure performance relative to the control indicating that the inventive sulfurized isobutylene oligomers provide extreme pressure performance consistent to non-caustic treated isobutylene oligomers. Inventive lubricant C with the sulfurized isobutylene from Example 2 provided the best extreme pressure performance.

Example 4

Lubricants A, B, and C of Example 3 were evaluated for solubility in an API Group III base oil (Yubase 4) and an API Group IV PAO base oil (Spectrasyn). The lubricants of this evaluation had the same composition as set forth in Example 3 except each fluid further included the same amounts of a thiadiazole additive. For this evaluation, about 3.25 weight percent of each lubricant was blended into the base oils at room temperature (25° C.) and solubility was observed. Results are provided in Table 5 below and shown in the images of FIGS. 1 and 2.

TABLE 5

| Lubricant | Sulfurized Isobutylene | Solubility in API Group III Base Oil (FIG. 1) | Solubility in API Group IV Base Oil (FIG. 2) |
|---|---|---|---|
| Lubricant A (Comparative) | Comparative Example 1 | Clear | Cloudy |
| Lubricant B (Inventive) | Example 1 | Clear | Clear |
| Lubricant C (Inventive) | Example 2 | Clear | Clear |

Figure 2:
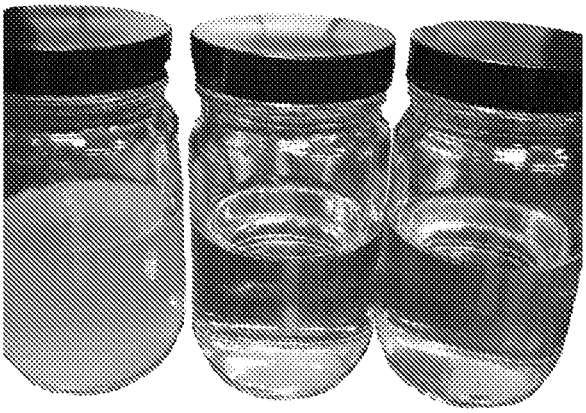
FIG. 2 is an image of three lubricant additives in a Group IV base oil including one comparative and two inventive sulfurized isobutylene oligomers of the present disclosure showing that the comparative sulfurized isobutylene oligomer was not soluble (left container) in the Group IV oil and that the two inventive sulfurized isobutylene oligomers were soluble in a Group IV oil in view of the clear solutions (middle and right containers).

FIG. 2 shows that Comparative Lubricant A with the non-caustic treated sulfurized isobutylene oligomer was not soluble in PAO in view of the cloudy mixture (left container), but Inventive Lubricants B and C with the inventive caustic treated sulfurized isobutylene oligomers were soluble in both the Group III (FIG. 1) and Group IV base oils (FIG. 2).

It is noted that, as used in this specification and the appended claims, the singular forms a," "an," and "the," include plural referents unless expressly and unequivocally limited to one referent. Thus, for example, reference to "an antioxidant" includes two or more different antioxidants. As used herein, the term "include" and its grammatical variants are intended to be non-limiting, such that recitation of items in a list is not to the exclusion of other like items that can be substituted or added to the listed items.

For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

It is to be understood that each component, compound, substituent or parameter disclosed herein is to be interpreted as being disclosed for use alone or in combination with one or more of each and every other component, compound, substituent or parameter disclosed herein.

It is further understood that each range disclosed herein is to be interpreted as a disclosure of each specific value within the disclosed range that has the same number of significant digits. Thus, for example, a range from 1 to 4 is to be interpreted as an express disclosure of the values 1, 2, 3 and 4 as well as any range of such values.

It is further understood that each lower limit of each range disclosed herein is to be interpreted as disclosed in combination with each upper limit of each range and each specific value within each range disclosed herein for the same component, compounds, substituent or parameter. Thus, this disclosure to be interpreted as a disclosure of all ranges derived by combining each lower limit of each range with each upper limit of each range or with each specific value within each range, or by combining each upper limit of each range with each specific value within each range. That is, it is also further understood that any range between the endpoint values within the broad range is also discussed herein. Thus, a range from 1 to 4 also means a range from 1 to 3, 1 to 2, 2 to 4, 2 to 3, and so forth.

Furthermore, specific amounts/values of a component, compound, substituent or parameter disclosed in the description or an example is to be interpreted as a disclosure of either a lower or an upper limit of a range and thus can be combined with any other lower or upper limit of a range or specific amount/value for the same component, compound, substituent or parameter disclosed elsewhere in the application to form a range for that component, compound, substituent or parameter.

While particular embodiments have been described, alternatives, modifications, variations, improvements, and substantial equivalents that are or can be presently unforeseen can arise to applicants or others skilled in the art. Accordingly, the appended claims as filed and as they can be amended are intended to embrace all such alternatives, modifications variations, improvements, and substantial equivalents.

What is claimed is:

1. A sulfurized polyolefin oligomer made by a process comprising the steps of:

(a) reacting a C2 to C18 olefin with a sulfur halide to form an intermediate sulfurized olefin reaction product;

(b) reacting the intermediate sulfurized olefin reaction product with an alkali metal hydrosulfide, an alkali metal hydroxide, and sulfur in an aqueous solution to form a sulfurized polyolefin reaction product;

(c) treating the sulfurized polyolefin reaction product with an aqueous alkaline solution for a time and a temperature effective to form the sulfurized polyolefin oligomer; and wherein the aqueous alkaline solution is about 40 to about 60 weight percent of an alkali metal hydroxide and being free of alcohols or ketones.

2. The sulfurized polyolefin oligomer of claim 1, wherein a copper coupon immersed in the sulfurized polyolefin oligomer for about 180 minutes at about 121° C. pursuant to ASTM D130 exhibits about 15 mg or less of copper weight loss and wherein about 2 to about 5 weight percent of the sulfurized polyolefin oligomer is soluble in both an API Group III base oil and an API Group IV base oil.

3. The sulfurized polyolefin oligomer of claim 1, wherein the sulfurized polyolefin oligomer has a structure of Formula I:

$$R—S_x—R—[S_x—R—S_x]_n—R \quad \text{(Formula I)}$$

wherein each R is, independently, a C2 to C6 linear or branched carbon chain, x is an integer from 1 to 5, and n is an integer such that the sulfurized polyolefin oligomer has a weight average molecular weight of about 300 to about 800.

4. The sulfurized polyolefin oligomer of claim 3, wherein the sulfurized polyolefin oligomer has about 30 to about 50 weight percent sulfur.

5. The sulfurized polyolefin oligomer of claim 1, wherein the olefin is selected from the group consisting of ethylene; propylene; isopropylene; butylene; isobutylene; n-pentylene; isopentylene; neopentylene; hexene; octene; styrene; aw-diolefins; 1,5-hexadiene; 1,6-heptadiene; 1,7-octadiene; branched chain alpha-olefins; methyl-pentene; methyl-heptene; or mixtures thereof.

6. The sulfurized polyolefin oligomer of claim 5, wherein the sulfur halide is selected from sulfur monochloride, sulfur dichloride, disulfur dibromide, sulfur dibromide, or mixtures thereof.

7. The sulfurized polyolefin oligomer of claim 6, wherein the alkali metal hydroxide is selected from sodium hydroxide, potassium hydroxide, lithium hydroxide or combinations thereof.

8. The sulfurized polyolefin oligomer of claim 7, wherein the treating is at a temperature of about 100° C. to about 150° C. for about 1 to about 5 hours.

9. The sulfurized polyolefin oligomer of claim 8, wherein the treating includes about 10 to about 50 weight percent of the aqueous alkaline solution.

10. The sulfurized polyolefin oligomer of claim 1, wherein the intermediate sulfurized olefin reaction product of step (a) is obtained by reacting about 0.4 to about 2 mols of the C2 to C18 olefin per about 0.3 to about 0.8 moles of the sulfur halide;

wherein the sulfurized polyolefin reaction product of step (b) is obtained by reacting about 0.2 to about 0.5 mols of sulfur per mol of the intermediate sulfurized olefin reaction product, about 0.7 to about 1.1 moles of the alkali metal hydroxide per mol of the intermediate sulfurized olefin reaction product, and a weight ratio of 0.01:1 to about 0.25:1 of sulfur to the alkali metal hydrosulfide sodium; and wherein the sulfurized polyolefin oligomer of step (c) is obtained by treating the sulfurized polyolefin reaction product with about 10 to about 50 weight percent of the aqueous alkaline solution having about 40 to about 60 weight percent of an alkali metal hydroxide.

11. The sulfurized polyolefin oligomer of claim 1, wherein the intermediate sulfurized olefin reaction product is obtained by reacting sulfur monochloride, sulfur dichloride, or combinations thereof with a C2 to C4 olefin, wherein the sulfurized polyolefin reaction product is obtained by reacting the intermediate sulfurized olefin reaction product with sodium hydrosulfide, sodium hydroxide, and elemental sulfur, and wherein the sulfurized polyolefin reaction product is treated with about 12 to about 40 weight percent of aqueous sodium hydroxide to form the sulfurized polyolefin oligomer.

12. A lubricating composition including a major amount of base oil selected from an API Group I to API Group V base oil and a minor amount of a sulfurized polyolefin oligomer, wherein the sulfurized polyolefin oligomer is made by a process comprising the steps of:

(a) reacting a C2 to C18 olefin with a sulfur halide to form an intermediate sulfurized olefin reaction product;

(b) reacting the intermediate sulfurized olefin reaction product with an alkali metal hydrosulfide, an alkali metal hydroxide, and sulfur in an aqueous solution to form a sulfurized polyolefin reaction product; and (c) treating the sulfurized polyolefin reaction product with an aqueous alkaline solution for a time and a temperature effective to form the sulfurized polyolefin oligomer; and wherein the aqueous alkaline solution is about 40 to about 60 weight percent of an alkali metal hydroxide and being free of alcohols or ketones.

13. The lubricating composition of claim 12, wherein a copper coupon immersed in the sulfurized polyolefin oligomer for about 180 minutes at about 121° C. pursuant to ASTM D130 exhibits less than about 15 mg of copper weight loss and wherein about 2 to about 5 weight percent of the sulfurized polyolefin oligomer is soluble in both an API Group III base oil and an API Group IV base oil.

14. The lubricating composition of claim 12, wherein the sulfurized polyolefin oligomer has a structure of Formula I:

$$R—S_x—R—[S_x—R—S_x]_n—R \quad \text{(Formula I)}$$

wherein each R is, independently, a C2 to C6 linear or branched carbon chain, x is an integer from 1 to 5, and n is an integer such that the sulfurized polyolefin oligomer has a weight average molecular weight of about 300 to about 800.

15. The lubricating composition of claim 14, wherein the sulfurized polyolefin oligomer has about 30 to about 50 weight percent sulfur.

16. The lubricating composition of claim 15, wherein the olefin is selected from the group consisting of ethylene; propylene; isopropylene; butylene; isobutylene; n-pentylene; isopentylene; neopentylene; hexene; octene; styrene; aw-diolefins; 1,5-hexadiene; 1,6-heptadiene; 1,7-octadiene; branched chain alpha-olefins; methyl-pentene; methyl-heptene; or mixtures thereof.

17. The lubricating composition of claim 16, wherein the sulfur halide is selected from sulfur monochloride, sulfur dichloride, disulfur dibromide, sulfur dibromide, or mixtures thereof.

18. The lubricating composition of claim 17, wherein the alkali metal hydroxide is selected from sodium hydroxide, potassium hydroxide, or combinations thereof.

19. The lubricating composition of claim 18, wherein the treating is at a temperature of about 100° C. to about 150° C. for about 1 to about 5 hours.

20. The lubricating composition of claim 19, wherein the treating includes about 10 to about 50 weight percent of the aqueous alkaline solution.

21. The lubricating composition of claim 12, wherein the intermediate sulfurized olefin reaction product of step (a) is obtained by reacting about 0.4 to about 2 mols of the C2 to C18 olefin per about 0.3 to about 0.8 moles of the sulfur halide;

wherein the sulfurized polyolefin reaction product of step (b) is obtained by reacting about 0.2 to about 0.5 mols of sulfur per mol of the intermediate sulfurized olefin reaction product, about 0.7 to about 1.1 moles of the alkali metal hydroxide per mol of the intermediate sulfurized olefin reaction product, and a weight ratio of 0.01:1 to about 0.25:1 of sulfur to the alkali metal hydrosulfide sodium; and wherein the sulfurized polyolefin oligomer of step (c) is obtained by treating the sulfurized polyolefin reaction product with about 10 to about 50 weight percent of the aqueous alkaline solution having about 40 to about 60 weight percent of an alkali metal hydroxide.

22. The lubricating composition of claim 12, wherein the intermediate sulfurized olefin reaction product is obtained by reacting sulfur monochloride, sulfur dichloride, or combinations thereof with a C2 to C4 olefin, wherein the sulfurized polyolefin reaction product is obtained by reacting the intermediate sulfurized olefin reaction product with sodium hydrosulfide, sodium hydroxide, and elemental sulfur, and wherein the sulfurized polyolefin reaction product is treated with about 12 to about 40 weight percent of aqueous sodium hydroxide to form the sulfurized polyolefin oligomer.

* * * * *